United States Patent [19]

Haber et al.

[11] Patent Number: 4,790,307

[45]. Date of Patent: Dec. 13, 1988

[54] DISPOSABLE SURGICAL MASK HAVING A SELF-CONTAINED SUPPLY OF ANTI-BACTERIAL MATERIAL

[75] Inventors: Terry M. Haber, Lake Forest, Calif.; Romeo LeMarie, Hong Kong, Hong Kong

[73] Assignee: Habley Medical Technology Corporation, Laguna Hills, Calif.

[21] Appl. No.: 941,311

[22] Filed: Dec. 15, 1986

[51] Int. Cl.[4] ..... A62B 7/10

[52] U.S. Cl. ..... 128/206.19; 128/206.13

[58] Field of Search ..... 128/206.19, 206.12, 128/206.13, 206.28, 206.21, 206.16, 206.17, 207.11; 604/303, 304, 305, 306, 307, 308

[56] References Cited

U.S. PATENT DOCUMENTS

| | | | |
|---|---|---|---|
| 1,292,096 | 4/1918 | Schwartz | 128/206.16 |
| 2,458,580 | 1/1949 | Fisketti et al. | 128/206.19 |
| 3,101,709 | 8/1963 | Gruenewaelder | 128/206.12 |
| 3,306,292 | 2/1967 | Spees | 604/306 |
| 3,464,413 | 9/1969 | Goldfarb et al. | 604/306 |
| 3,580,254 | 5/1971 | Stuart | 604/306 |
| 4,467,799 | 8/1984 | Steinberg | 128/206.19 |

*Primary Examiner*—Edward M. Coven
*Assistant Examiner*—K. M. Reichle
*Attorney, Agent, or Firm*—Morland C. Fischer

[57] ABSTRACT

A disposable surgical mask which reduces the transmission of iatrogenic or nosocomial, viral or bacterial infection by operating room personnel. The mask includes a containment envelope within which is sealed a rupturable membrane (e.g., an ampule) containing an anti-bacterial fluid. A series of breathing apertures are formed in the containment envelope through which the wearer may breathe. In operation, the wearer supplies sufficient force to break the rupturable membrane and thereby release the anti-bacterial fluid therefrom. The wearer then breathes normally through the apertures formed in the containment envelope, so that the potentially infectious bacterial population of the wearer's exhalations will be substantially reduced by the anti-bacterial fluid expulsed from the ruptured membrane.

3 Claims, 4 Drawing Sheets

DISPOSABLE SURGICAL MASK HAVING A SELF-CONTAINED SUPPLY OF ANTI-BACTERIAL MATERIAL

BACKGROUND OF THE INVENTION

1. Field of the Invention

This invention relates to a surgical mask having a self-contained supply of anti-bacterial fluid carried therewithin by which to reduce the transmission of iatrogenic and nosocomial infection by operating room doctors and nurses.

2. Prior Art

In an attempt to provide a germ-free environment, medical personnel including doctors and nurses, are required to wear surgical masks in an operating room. Unfortunately, the conventional surgical mask is not completely adequate to protect the patient from iatrogenic infection transmitted by the mask wearer. That is to say, after a relatively short time, the conventional surgical mask may become contaminated by the respirations of the wearer and rendered ineffectual in filtering and intercepting potentially harmful bacteria, and, consequently, may fail to reliably prevent the spread of infectious disease in the operating room. If not properly and immediately disposed of after use, the conventional surgical mask may actually carry and harbor disease. The conventional mask typically includes tie strings by which to attach the mask over the wearer's face. However, such tie strings may be awkward to tie and even more awkward to release, such that the wearer may require assistance before the mask can be suitably removed. Tie strings, which are not correctly tied or which may loosen during an operating room procedure, contribute to the undesirability of the conventional surgical mask as an adequate and reliable means for protecting the patient against iatrogenic and nosocomial infection.

SUMMARY OF THE INVENTION

Briefly, and in general terms, a disposable surgical mask is disclosed which overcomes the problems inherent with conventional masks. The mask of the present invention provides a reliable means for protecting the operating room patient against the spread of infectious disease. The mask includes a flat bottom layer and a top layer which is secured to and extends over a portion of the bottom layer to define a hollow compartment therebetween. A pair of ear holes are formed at opposite ends of the bottom layer. Located within the compartment, between the top and bottom mask layers, is a sealed containment envelope formed from an air impenetratable material. A series of breathing apertures are formed in the containment envelope through which the wearer may breathe. Sandwiched between a pair of fluid absorbent, fibrous pads and sealed within the containment envelope is a rupturable membrane or ampule. The membrane is filled with an anti-bacterial fluid, such as Betadine, or the like.

In operation, the wearer first applies a sufficient force against the upper mask layer to break the rupturable membrane and thereby release the anti-bacterial fluid with which the membrane is filled. The fluid is absorbed by and evenly distributed through the fibrous pads which surround the membrane. The wearer may, then, quickly and easily attach the mask to his face by fitting his ears through the oppositely aligned ear holes. Thus, the mask is automatically and accurately positioned across the wearer's nose and mouth for preserving a sterile, germ-free operating room environment. The wearer breathes normally through the breathing apertures formed in the containment membrane, so that any air-borne, infectious bacteria will be intercepted and destroyed by the anti-bacterial fluid released from the ruptured membrane and absorbed by the fibrous pads.

DESCRIPTION OF THE PREFERRED EMBODIMENT

Figure 1:
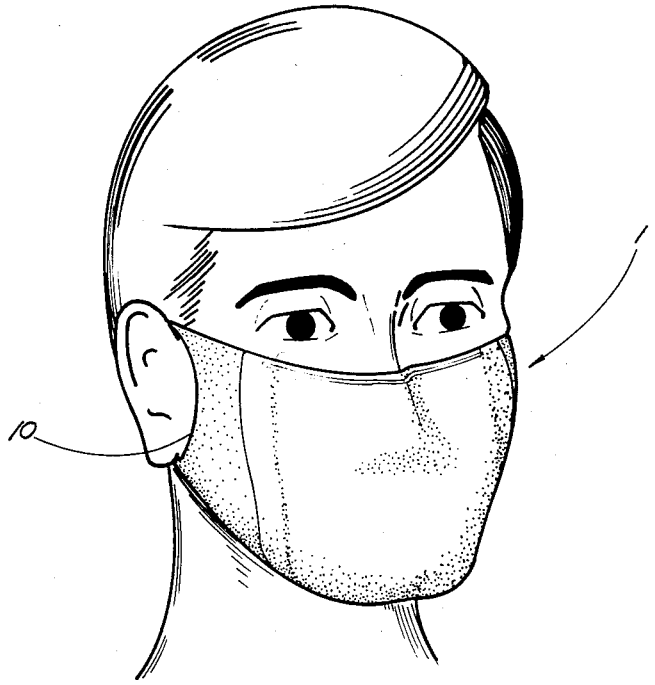
FIG. 1 shows the surgical mask which forms the present invention attached across the face of a wearer.
Figure 2:
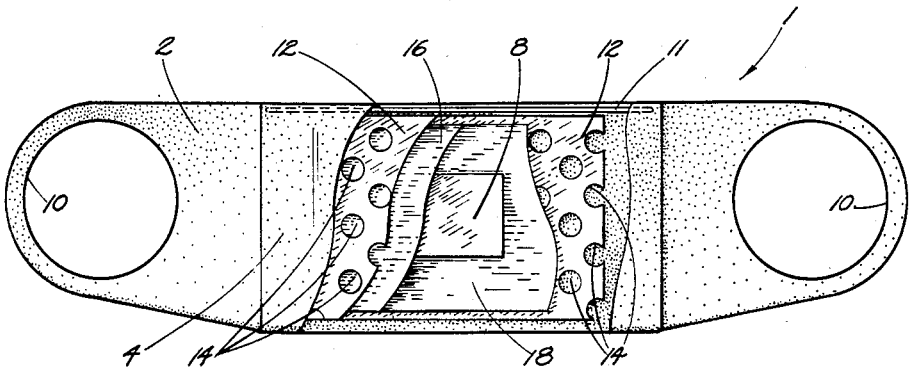
FIG. 2 is a front view of the surgical mask in partial cross-section.
Figure 3:
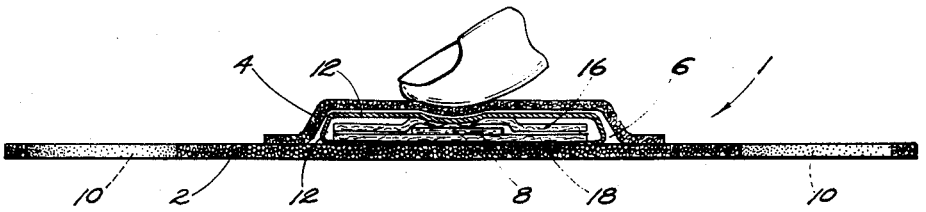
FIG. 3 is an end view of the surgical mask in partial cross-section.

The disposable surgical mask which forms the present invention is best described while referring concurrently to FIGS. 1–3 of the drawings. Mask 1 comprises a flat, continuous bottom layer 2 to which a top layer 4 is attached. As best illustrated in FIG. 3, the top layer 4 covers a portion of the bottom layer 2 to define a hollow compartment 6 therebetween in which a rupturable membrane 8 is enclosed. The details and advantages of rupturable membrane 8 will be disclosed in greater detail hereinafter. The bottom and top layers 2 and 4 of mask 1 are preferably formed from a flexible, lightweight material, such as molded foam, or the like. A segment of flexible wire 11 is secured between bottom and top layers 2 and 4, so that the mask 1 can be shaped to conform to the contour of the wearer's nose. A pair of generally circular ear holes 10 are formed at opposite ends of the bottom layer 2, so as to receive the ears of the wearer therethrough (best illustrated in FIG. 1). In this manner, the mask may be easily and reliably secured across the nose and mouth of the wearer, whereby to obviate the need for the cumbersome and often unreliable tie strings commonly associated with conventional masks. Moreover, the user may quickly secure and accurately position the mask in the operating room without the need for additional assistance, as is often required as a consequence of the conventional mask design.

Located within the compartment 6 between the bottom and top layers 2 and 4 is a hollow, heat sealed containment packet or envelope 12 in which the rupturable membrane 8 is housed. The containment envelope 12 is formed from a hydrophobic, air-impermeable material, such as plastic, or the like. A series of breathing apertures 14 are formed through opposing faces of containment envelope 12, so as to permit the wearer to breathe therethrough.

Sandwiched between a pair of pads 16 and 18 is the rupturable membrane 8. Pads 16 and 18 are preferably formed from a fluid absorbent, fibrous material, such as sterile cotton, gauze, or the like. The pads 16 and 18 and membrane 8 are sealed within the containment envelope 12 during manufacture of the mask 1. The fibrous pads 16 and 18 surround and cushion the rupturable membrane against inadvertent breakage. Moreover, the pads 16 and 18 serve to trap air-borne contaminants which pass through the breathing apertures 14. The rupturable membrane 8 is formed from a suitable hydrophobic material (e.g., a glass or plastic ampule, or the like) which is adapted to fracture under the application of a predetermined minimum force. The membrane 8 is filled with an active anti-bacterial fluid, such as Betadine, or the like, which is non-toxic to the wearer.

In operation, the user (i.e., an operating room surgeon or nurse) applies sufficient pressure to rupture the membrane 8 which is sealed within containment envelope 12. By way of example and as is best illustrated in FIG. 3, the mask 1 is pressed between the fingers of the wearer, whereby to rupture membrane 8 and release the anti-bacterial fluid therefrom. The pads 16 and 18 which surround membrane 8 are thereby saturated with the anti-bacterial fluid. The fluid is evenly distributed through the fibrous material of pads 16 and 18 by means of capillary action.

Figure 4:
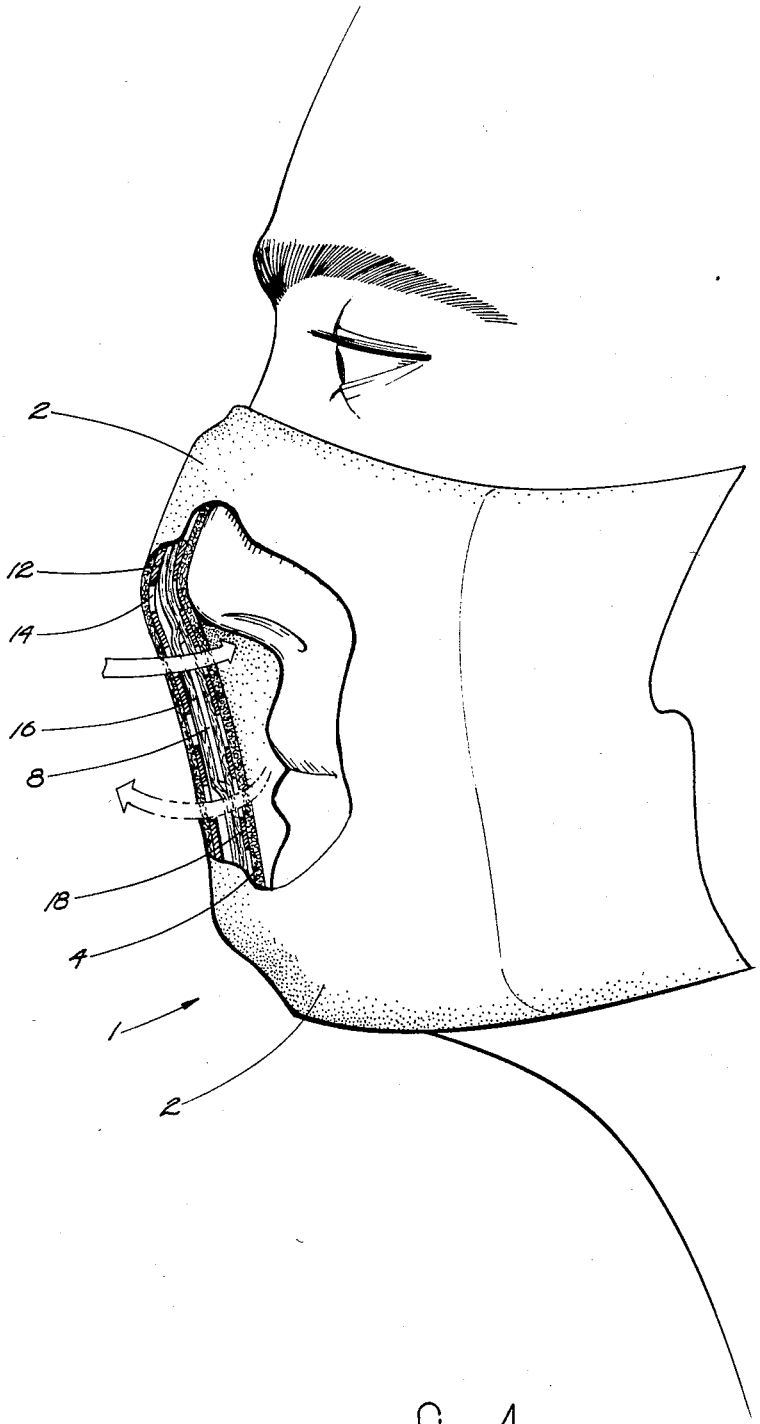
FIG. 4 shows the surgical mask, in partial cross-section, attached across the face of a wearer.

The wearer then attaches the mask 1 by arranging the ear holes 12 around each of his ears. By virtue of ear holes 10, and as is best illustrated in FIG. 4 of the drawings, the mask is easily and automatically positioned, such that the containment envelope 12 in which the ruptured membrane 8 is carried is accurately, completely and securely disposed across the wearer's nose and mouth. The wearer breathes normally through the breathing apertures 12 formed in and around the containment envelope 12, so that nosocomial disease transmitted to or from the wearer will be filtered, such that the bacterial population of the wearer's exhalations will be substantially reduced by the anti-bacterial fluid which has saturated the fibrous pads 16 and 18 from membrane 8. Accordingly, and by virtue of the present invention, an operating room patient will be more completely protected against nosocomial infection which could occur as a result of faulty, ineffective or unreliable surgical masks, as have heretofore been known and used.

Figure 5:
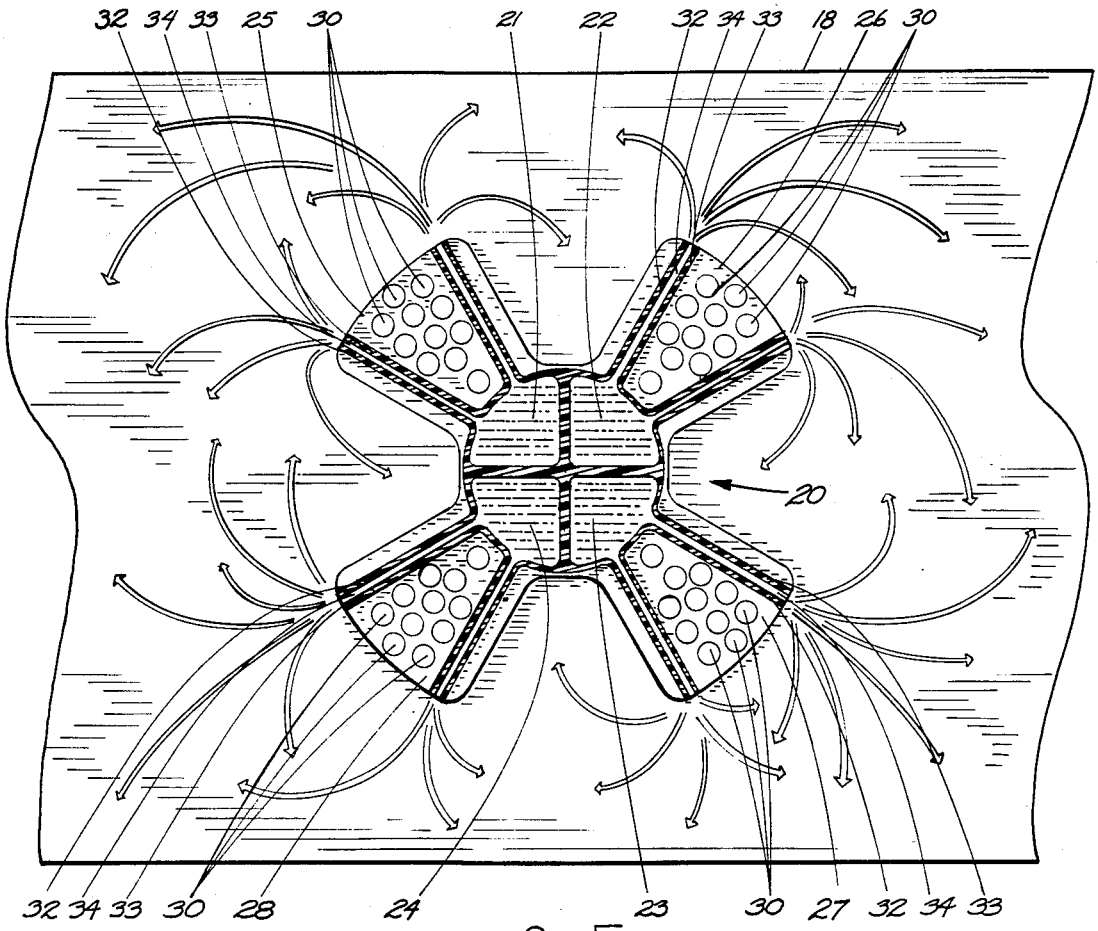
FIGS. 5–7 show an alternate embodiment of the present invention.
Figure 6:
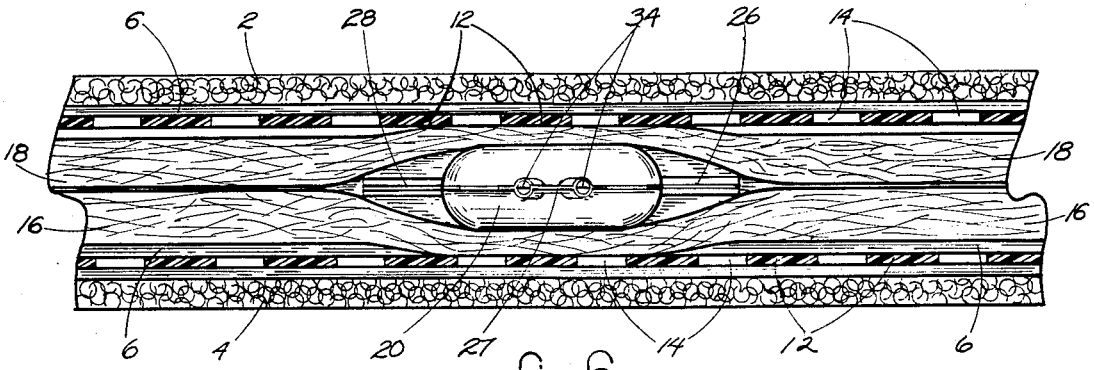
Figure 7:
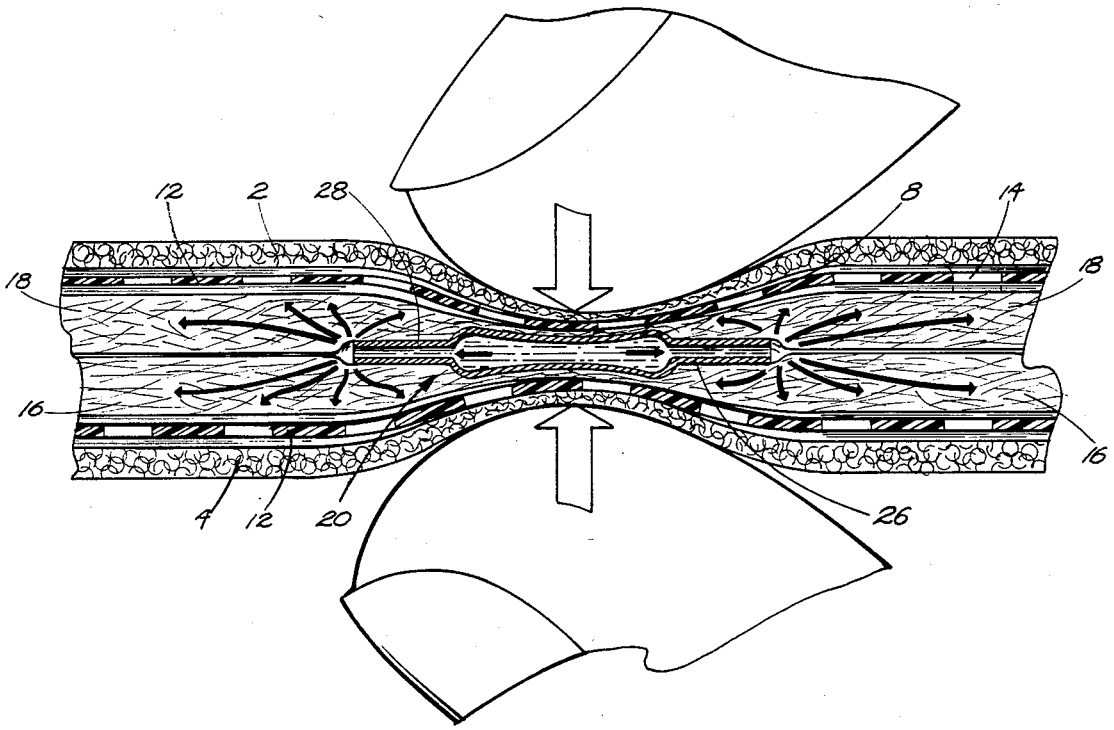

FIGS. 5–7 of the drawings illustrate an alternate embodiment of the present invention. In FIGS. 5 and 6, there is shown a rupturable, fluid retaining and dispersing membrane 20. Like the membrane 8 which was disclosed when previously referring to FIGS. 1–4, the fluid retaining and dispersing membrane 20 is sandwiched between a pair of fluid absorbent fibrous pads 16 and 18. Moreover, and as is best shown in FIG. 6, membrane 20 is sealed within a hydrophobic, air-impermeable containment envelope 12 through which is formed a matrix of breathing apertures 14. Containment envelope 12 and the membrane 20 therewithin are located in the hollow compartment 6 formed between the lower and upper mask layers 2 and 4.

However, unlike membrane 8, the fluid retaining and dispersing membrane 20 includes a plurality of (e.g. four) centrally disposed fluid reservoirs 21–24 which contain separate supplies of anti-bacterial fluid. Membrane 20 is formed from a rupturable hydrophobic material, such as plastic, or the like. A plurality of fluid dispersing arms 25–28 radiate outwardly from respective fluid reservoirs 21–24. Each of the fluid dispersing arms 25–28 comprises a relatively flat member having a matrix of holes 30 formed therein by which to minimize the mass of membrane 20. One or more pairs of solid reinforcing ribs 32, 33 extend longitudinally along each of the arms 25–28. Each pair of ribs 32, 33 defines a fluid passage or channel 34 which communicates with respective ones of the reservoirs 21–24, so that anti-bacterial fluid can be dispersed from the reservoirs to the pads 16 and 18 which surround retaining and dispersing membrane 20. The distal ends of ribs 32 and 33 are crimped together (best shown in FIG. 7) so as to prevent the unintended flow of anti-bacterial fluid outwardly from passages 34.

In operation, and referring to FIG. 7, the operating room surgeon or nurse applies sufficient pressure to rupture the fluid retaining and dispersing membrane 20. By way of example, the surgical mask is grasped and the containment envelope 12 thereof is squeezed between the thumb and forefinger of the wearer, whereby to expulse the anti-bacterial fluid from the reservoir 21–24. A pressure head created by the expulsion of anti-bacterial fluid from the reservoirs 21–24 acts to overcome the crimped ends of ribs 32 and 33 and thereby open the passages 34 to the flow of fluid therethrough. By virtue of the fluid dispersing arms 25–28 and the fluid passages 34 which extend therealong, anti-bacterial fluid may be more evenly dispersed from the reservoirs 21–24 throughout the fibrous material of the pads 16 and 18 which surround membrane 20. That is, since each of the reservoirs 21–24 contains a supply of fluid which is separated from the other reservoirs, the fluid passages 34 will disperse the same volume of fluid to the fibrous pads 16 and 18, regardless of how hard and where the wearer squeezes the containment envelope 12 to rupture the membrane 20. The wearer then attaches the mask 12 as previously disclosed and breathes normally through the breathing apertures 12, so that nosocomial disease transmitted to or from the wearer will be filtered and the bacterial population of the wearer's exhalations reduced by the antibacterial fluid which has saturated pads 16 and 18 from the ruptured membrane 20.

It will be apparent that while a preferred embodiment of the invention has been shown and described, various modifications and changes may be made without departing from the true spirit and scope of the invention. By way of example, the hollow compartment 6 formed by the attachment of the upper mask layer 4 to the lower mask layer 2, may be opened along one side thereof. In this manner, the sealed containment envelope 12 in which the rupturable membrane 8 or 20 is located may be removed from a sterile environment for placement within the hollow compartment 6. Hence, the containment envelope 12 may be stored in a sterile, germ-free environment until immediately prior to the time that the surgical mask 1 of the present invention is ready to be used.

Having thus set forth a preferred embodiment of the present invention, what is claimed is:

1. A surgical mask to reduce the possibility of iatrogenic and nosocomial disease transmitted by a wearer of the mask, said mask comprising:

means for securing said mask to the face of a wearer;

top and bottom layers of air permeable material;

rupturable container means located between said top and bottom layers and having a plurality of fluid reservoirs in which respective supplies of anti-bacterial fluid are contained, said container means adapted to rupture upon the application of a predetermined minimum force to expulse said anti-bacterial fluid from said plurality of fluid reservoirs;

an absorbent material located between said top and bottom layers to surround said container means for absorbing and dispensing said anti-bacterial fluid from said fluid reservoirs when said container means is ruptured and said fluid is expulsed; and fluid channel means extending from respective ones of said fluid reservoirs for evenly distributing said anti-bacterial fluid throughout said absorbent material when said container means is ruptured and said fluid is expulsed.

2. The surgical mask recited in claim 1, wherein said container means and said absorbent material are sealed within a containment envelope that is located between said top and bottom layers, said envelope being formed from a hydrophobic, air-impermeable material and having a plurality of breathing apertures through which the wearer may breathe for introducing the wearer's breath to the anti-bacterial which is absorbed by said absorbent material when said fluid container means is ruptured.

3. The surgical mask recited in claim 1, wherein said securing means comprises holes formed through opposite ends of one of said top or bottom layers to receive the ears of the wearer and thereby secure said mask across the wearer's face.

* * * * *